US007034782B2

(12) United States Patent
Miyakawa et al.

(10) Patent No.: US 7,034,782 B2
(45) Date of Patent: Apr. 25, 2006

(54) DEVICE AND METHOD FOR DRIVING DISPLAY PANEL

(75) Inventors: Junichi Miyakawa, Kawagoe (JP); Masaru Sasaki, Kawagoe (JP); Takeshi Higuma, Kawagoe (JP); Hiroyuki Kazama, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/686,742

(22) Filed: Oct. 17, 2003

(65) Prior Publication Data

US 2004/0080472 A1 Apr. 29, 2004

(30) Foreign Application Priority Data

Oct. 21, 2002 (JP) ..... 2002-305950

(51) Int. Cl.
*G09G 3/82* (2006.01)

(52) U.S. Cl. ..... 345/76; 345/36; 345/82
(58) Field of Classification Search ..... 345/76, 345/84, 98, 36, 45, 46, 55, 82
See application file for complete search history.

(56) References Cited

U.S. PATENT DOCUMENTS

| | | | | |
|---|---|---|---|---|
| 6,222,323 | B1 | 4/2001 | Yamashita et al. | 315/169.3 |
| 6,351,255 | B1 | 2/2002 | Ishizuka et al. | 345/77 |
| 2003/0184237 | A1 * | 10/2003 | Togashi et al. | 315/169.3 |
| 2004/0119669 | A1 * | 6/2004 | Ishizuka et al. | 345/83 |
| 2004/0155842 | A1 * | 8/2004 | Ishizuka | 345/76 |

FOREIGN PATENT DOCUMENTS

| | | |
|---|---|---|
| EP | 1 091 340 | 4/2001 |
| JP | 6-301355 | 10/1994 |
| JP | 2000-40074 | 2/2000 |
| JP | 2001-350431 | 12/2001 |

* cited by examiner

*Primary Examiner*—Xiao Wu
*Assistant Examiner*—Jean Lesperance
(74) *Attorney, Agent, or Firm*—Drinker Biddle & Reath LLP

(57) ABSTRACT

A display panel driving device that can obviate the need for constant current driving circuits in an anode driver circuit, in which a light emission column electrode lines is opened in a light emission period during scanning of each line of a display panel, and parasitic capacitors of light emitting elements are used to allow leak current from the combined parasitic capacitors of the non-scanned elements to the scanned elements to serve as the light emission current of the scanned elements.

6 Claims, 5 Drawing Sheets

RESET PERIOD
LIGHT EMISSION PERIOD
LINE SYNCHRONIZATION PULSE
LINE SYNCHRONIZATION SIGNAL
TIME

LIGHT EMISSION COLUMNS : SWITCH OPEN
NON - LIGHT EMISSION COLUMNS : Vascn
OUTPUT OF ANODE DRIVER IC
Va0
0v
TIME Vc0
SCAN LINE OUTPUT OF CATHODE DRIVER IC
Vcscn
0v
TIME Vc0
NON - SCAN LINE OUTPUT OF CATHODE DRIVER IC
Vrev
0v
TIME RESET PERIOD
LIGHT EMISSION PERIOD
LINE SYNCHRONIZATION PULSE
LINE SYNCHRONIZATION SIGNAL
TIME LIGHT EMISSION COLUMNS : SWITCH OPEN
NON - LIGHT EMISSION COLUMNS : 0v
OUTPUT OF ANODE DRIVER IC
0v
TIME SCAN LINE OUTPUT OF CATHODE DRIVER IC
0v
TIME NON - SCAN LINE OUTPUT OF CATHODE DRIVER IC
Vc
0v
TIME

DEVICE AND METHOD FOR DRIVING DISPLAY PANEL

BACKGROUND OF THE INVENTION

1. Field of the Invention

The present invention relates to a device and a method for driving a display panel.

2. Description of the Related Art

In a conventional display panel employing organic electroluminescence elements (referred to simply as EL elements hereinafter), the organic EL elements are arranged in a matrix and are illuminated by using a driving device which includes an anode driver and a cathode driver (for example, Japanese Patent Kokai No. 2000-40074, No. 2001-350431, and No. H06-301355). The drivers are often built in the form of a single chip IC so that the driving device can be made small.

FIG. 1 shows a conventional organic EL display panel having a so-called simple matrix configuration with a plurality of row electrode lines and a plurality of column electrode lines, and also shows the configuration of a driving device for the display panel.

In FIG. 1, organic EL elements ELD are arranged in a matrix (n rows×m columns) in an organic EL display panel 1.

Each of the organic EL elements consists of an anode electrode, a cathode electrode, and an organic EL light emitting layer sandwiched between the anode electrode and the cathode electrode, and has rectifying properties like ordinary diodes. Also, as shown in FIG. 1, since each of the organic EL elements ELD has a parasitic capacitance C in the organic EL light emitting layer, the parasitic capacitor C is indicated as an element equivalently connected in parallel to each of the organic EL elements ELD.

The anode electrodes of the organic EL elements ELD are connected to an anode driver IC 2 through the corresponding column electrode line of the matrix for each column. Also, the cathode electrodes are connected to a cathode driver IC 3 through the corresponding row electrode line of the matrix for each row.

The anode driver IC 2 includes switching elements Sa1 to Sam, constant current driving circuits CCg, and pull-down resistors Ra corresponding to the column electrode lines, respectively. Each of the switching elements Sa1 to Sam is controlled in accordance with an anode driver control signal that is supplied from a control circuit (not shown). Each of the constant current driving circuits CCg is a constant current driving circuit having an output stage transistor is for example a PMOS-FET, and supplies a constant current signal to the organic EL elements, which serve as loads, on the basis of a voltage Va that is supplied from an anode driver power circuit (not shown). The pull-down resistors Ra are connected to a ground.

On the other hand, the cathode driver IC 3 includes switching elements Sc1 to Scn, pull-up resistors Rc, and pull-down resistors Rg corresponding to the row electrode lines, respectively. Each of the switching elements Sc1 to Scn is controlled in accordance with a cathode driver control signal that is supplied from the control circuit. The pull-up resistors Rc are connected to a supply line of a voltage Vc that is supplied from a cathode driver power circuit (not shown), and the pull-down resistors Rg are connected to a ground.

The operation of the circuit shown in FIG. 1 will be described below. First, in a reset period in synchronization with a line synchronization pulse included in the anode driver control signal, all the switching elements of the anode driver IC 2 and the cathode driver IC 3 are switched to the pull-down resistor side so as to uniform residual charges in all parasitic capacitances.

After that, in a light emission period, the switching element corresponding to a scanned line (row) in the cathode driver IC 3 is selected and is maintained in the selection state of the pull-down resistor side. On the other hand, the other switching elements of the non-scan lines are switched to the pull-up resistor Rc side. Also, in the anode driver IC 2, any switching elements corresponding to EL elements to be driven are switched in accordance with the anode driver control signal supplied from the control circuit, the constant current circuits CCg are connected to the column electrode lines, and the other column electrode lines corresponding to non-light emission elements are connected to the ground via the pull-down resistors Ra.

In the circuit shown in FIG. 1, more specifically, the second row is selected as the scanned line and grounded through the pull-down resistor Rg, and the first column and the m-th column electrode lines are connected to the constant current circuits CCg, in correspondence with the elements that are to be light-emitted. Thus, a drive current is allowed to flow from the anode to the cathode of each of the organic EL elements at the points of intersection of these column electrode lines and the row electrode line, and the organic EL elements shown in white in the organic EL display panel of FIG. 1 are light-emitted.

As described above, in conventional display panel driving devices, it is necessary to provide the constant current driving circuit CCg for each column in the anode driver IC 2. As a result, the structure of the anode driver IC becomes complex, making it difficult to downsize the anode driver IC and to reduce the cost. Also, since a current is constantly supplied from the constant current driving circuit to the column electrode line corresponding to an EL element to be driven for light emission, there is a problem in that the overall power consumption of the IC increases.

SUMMARY OF THE INVENTION

Accordingly, it is an object of the present invention to provide a device and a method for driving a display panel which can realize downsizing, cost reduction, and power saving.

A display panel driving device according to the present invention comprises: a display panel having a plurality of row electrode lines, a plurality of column electrode lines intersecting with the row electrode lines, and a plurality of capacitive light emitting elements arranged at a plurality of intersecting positions by the plurality of row electrode lines and the plurality of column electrode lines, respectively; a control circuit which generates a column drive control signal and a row drive control signal for each one cycle having a reset period and a light emission period in accordance with an input image signal, the row drive control signal indicating, as a scan line, one line of the plurality of row electrode lines and the column drive control signal indicating, as alight emission column electrode line corresponding to a capacitive light emitting element driven to emit light on the scan line, at least one line of a plurality of column electrode lines; a column electrode driver circuit which sets a potential of each of the plurality of column electrode lines in accordance with the column drive control signal; and a row electrode driver circuit which sets a potential of each of the plurality of row electrode lines in accordance with the row drive control signal; wherein the column electrode driver circuit, in the reset period supplies a first reset potential to each of the plurality of column electrode lines, and in the light emission period, opens the light emission column electrode line and supplies a non-light emission control potential to column electrode lines other than the light emission column electrode line of the plurality of column electrode lines; and wherein the row electrode driver circuit, in the reset period, supplies a second reset potential to each of the plurality of row electrode lines, and in the light emission period, supplies a selection potential to the scan line and supplies a non-selection potential to row electrode lines other than the scan line of the plurality of row electrode lines.

A display panel driving method according to the present invention for driving a display panel having a plurality of row electrode lines, a plurality of column electrode lines intersecting with the row electrode lines, and a plurality of capacitive light emitting elements arranged at a plurality of intersecting positions by the plurality of row electrode lines and the plurality of column electrode lines, respectively; comprises steps of: generating a column drive control signal and a row drive control signal for each one cycle having a reset period and a light emission period in accordance with an input image signal, the row drive control signal indicating, as a scan line, one line of the plurality of row electrode lines and the column drive control signal indicating, as alight emission column electrode line corresponding to a capacitive light emitting element driven to emit light on the scan line, at least one line of a plurality of column electrode lines; setting a potential of each of the plurality of column electrode lines in accordance with the column drive control signal; and setting a potential of each of the plurality of row electrode lines in accordance with the row drive control signal; wherein in the reset period, a first reset potential is supplied to each of the plurality of column electrode lines and a second reset potential is supplied to each of the plurality of row electrode lines, and in the light emission period, the light emission column electrode line is opened and a non-light emission control potential is supplied to column electrode lines other than the light emission column electrode line of the plurality of column electrode lines, a selection potential is supplied to the scan line and a non-selection potential is supplied to row electrode lines other than the scan line of the plurality of row electrode lines.

DESCRIPTION OF THE INVENTION

Hereinafter, embodiments of the present invention are described in detail with reference to the drawings.

Figure 1:
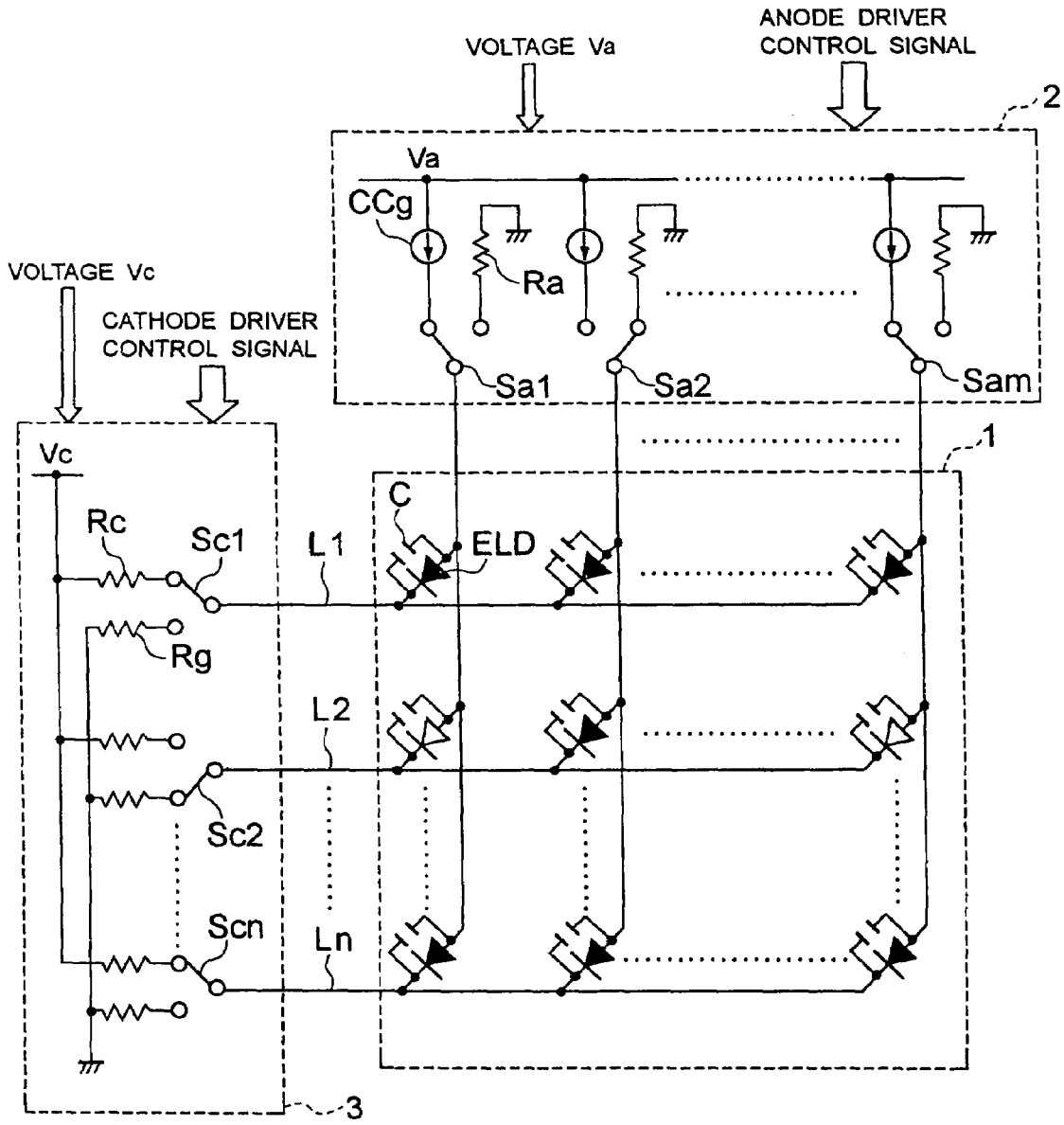
PRIOR ART FIG.1
FIG. 1 is a block diagram showing the configuration of a display panel and a driving circuit in a conventional organic EL display panel driving device.
Figure 2:
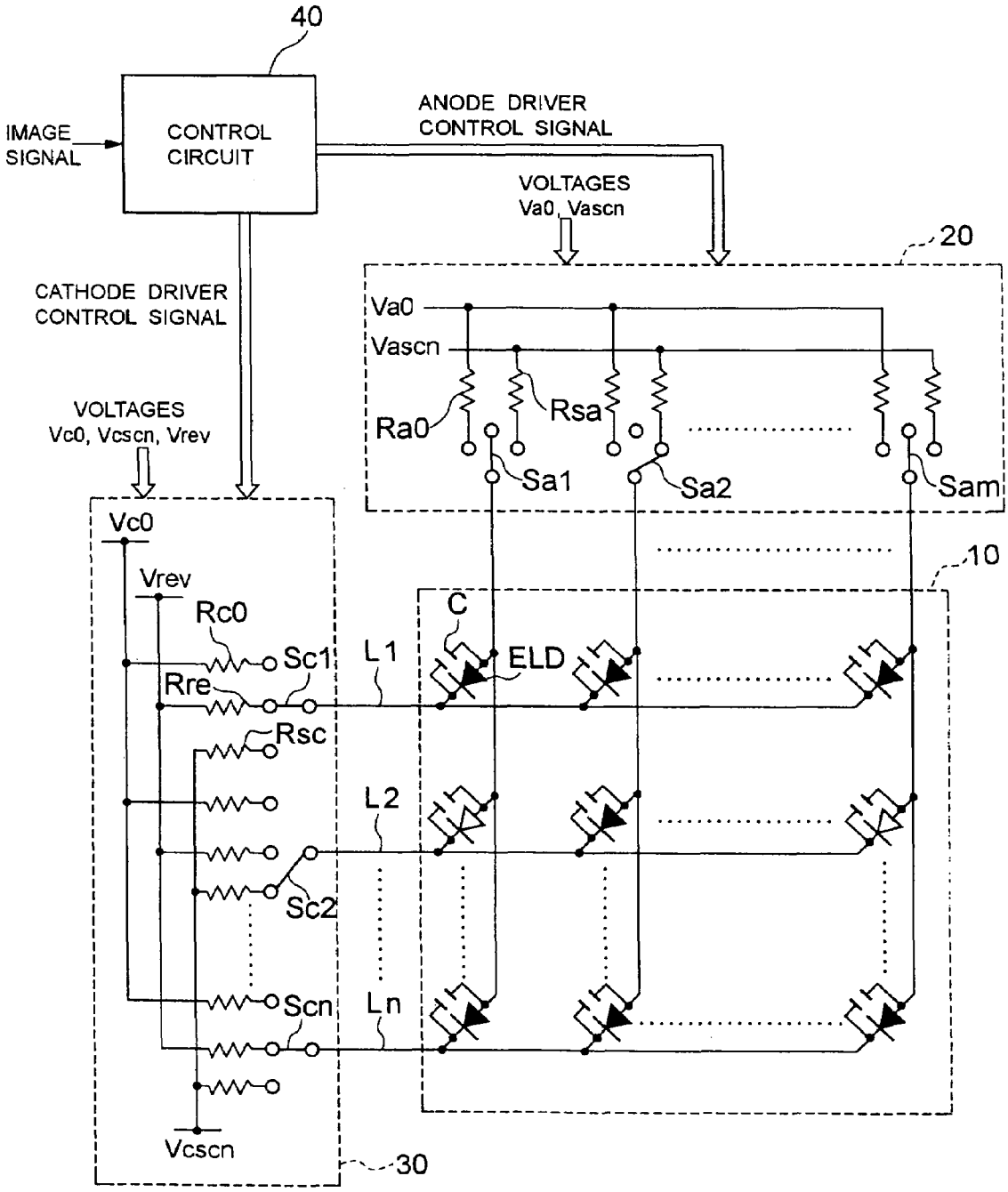
FIG. 2 is a block diagram showing an organic EL display panel driving device to which the present invention is adopted.

FIG. 2 shows, as an embodiment of the present invention, an organic EL display panel driving device in which organic EL elements as light emitting elements are used.

In FIG. 2, an organic EL display panel 10 has m column electrode lines and n row electrode lines L1 to Ln intersecting with the column electrode lines, and m×n organic EL elements ELD. The organic EL elements ELD are arranged at intersecting positions by the row electrode lines and the column electrode lines, respectively. Namely, the organic EL elements ELD are arranged in a matrix (n rows×m columns) in the organic EL display panel 10.

Each of the organic EL elements consists of an anode electrode, a cathode electrode, and an organic EL light emitting layer sandwiched between the anode electrode and the cathode electrode, and has rectifying properties like ordinary diodes. Also, as shown in FIG. 2, since each of the organic EL elements ELD has a parasitic capacitance C in the organic EL light emitting layer, the parasitic capacitor C is indicated as an element equivalently connected in parallel to each of the organic EL elements ELD.

The anode electrodes of the organic EL elements ELD are connected to an anode driver IC 20 through the corresponding column electrode line of the display panel 10 for each column. Also, the cathode electrodes are connected to a cathode driver IC 30 through the corresponding row electrode line of the matrix for each row.

The anode driver IC 20 includes switching elements Sa1 to Sam, and resistors Ra0 and Rsa corresponding to the column electrode lines, respectively. Each of the switching elements Sa1 to Sam is controlled in accordance with an anode driver control signal that is supplied from a control circuit 40. Each of the switching elements Sa1 to Sam has three selection states, a first selection state in which the selection output is connected to one end of the resistor Ra0, a second selection state in which the selection output is connected to one end of the resistor Rsa, and a neutral selection state in which the selection output is open. The other ends of the resistors Ra0 are connected to a supply line of a voltage Va0, and the other ends of the resistors Rsa are connected to a supply line of a voltage Vascn. The voltages Va0 and Vascn are supplied from an anode driver power circuit (not shown). The selection outputs of the switching elements Sa1 to Sam are connected to the column electrode lines, respectively.

On the other hand, the cathode driver IC 30 includes switching elements Sc1 to Scn, resistors Rc0, Rre, and Rsc corresponding to the row electrode lines, respectively. Each of the switching elements Sc1 to Scm has one of three selection states, a first selection state in which the selection output is connected to one end of the resistor Rc0, a second selection state in which the selection output is connected to one end of the resistor Rre, and a third selection state in which the selection output is connected to one end of the resistor Rsc, in accordance with a cathode driver control signal that is supplied from the control circuit 40. The other ends of the resistors Rc0 are connected to a supply line of a voltage Vc0, the other ends of the resistors Rre are connected to a supply line of a voltage Vrev, and the other ends of the resistors Rsc are connected to a supply line of a voltage Vcscn. The voltages Vc0, Vrev, and Vcscn are supplied from a cathode driver power circuit (not shown). The selection outputs of the switching elements Sc1 to Scn are connected to the row electrode lines, respectively. The operation of the circuit shown in FIG. 2 will be described with reference to the time charts shown in FIGS. 3A to 3D.

The control circuit 40 generates the anode driver control signal and cathode driver control signal in accordance with an input image signal.

Figures 3A, 3B, 3C, 3D:
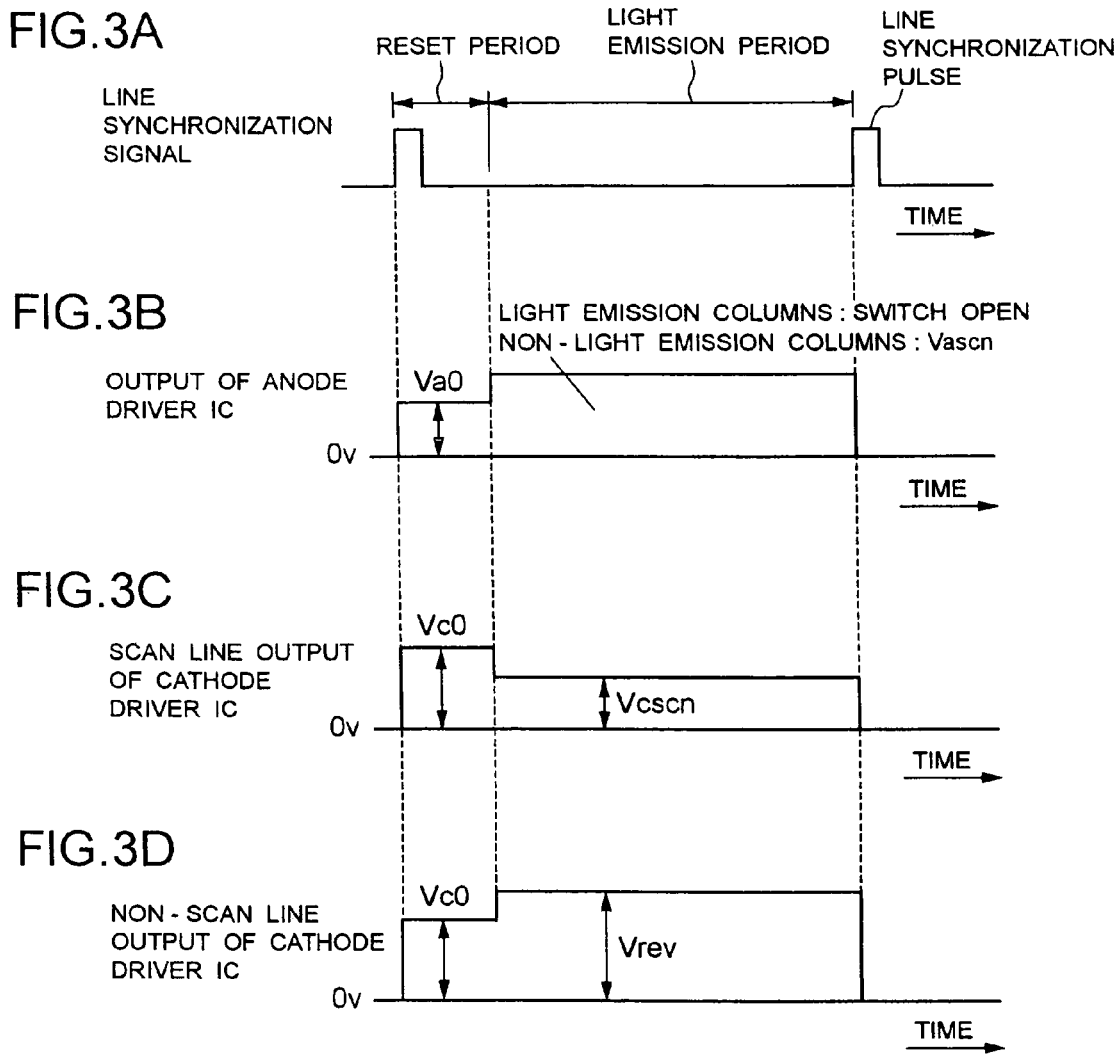
FIGS. 3A to 3D are time charts showing the operation of the device shown in FIG. 2.

FIG. 3A shows line synchronization pulses included in the cathode driver control signal that is supplied from the control circuit 40 to the driver IC 30. The cathode driver control signal is a signal which indicates one switch element of the switching elements Sc1 to Scn to select as a scan line, one row electrode line of the row electrode lines L1 to Ln in that order for each line synchronization pulse. The light emission operation for one line of the display panel 10 is carried out during one cycle of the line synchronization pulse. As shown in FIG. 3A, one cycle of the line synchronization pulse includes two periods, a reset period and a light emission period. Here, the reset period is a period during which an initializing process for the light emitting elements of the display panel 10 is carried out, and the light emission period is a period during which a process for actually light-emitting from desired light emitting elements.

FIG. 3B shows a state of the output from the anode driver IC 20 to the column electrode lines of the display panel 10.

Also, FIGS. 3C and 3D illustrate the change in the output from the cathode driver IC 30 to the row electrode lines of the display panel. FIG. 3C shows the output of a selected scan line, and FIG. 3D shows the output of the non-scan lines, that is, the lines other than the scan line.

First, in one cycle of a line synchronization pulse, when the reset period following the line synchronization pulse is begun, the initializing process for the display panel is performed in the anode driver IC 20 and the cathode driver IC 30.

The initializing process will be described in detail below. All the switching elements Sa1 to Sam of the anode driver IC 20 are switched to the resistor Ra0 side, setting the anode potential of each of the organic EL elements ELD connected to the column electrode lines of the display panel 10 to the voltage Va0. At the same time, all the switching elements Sc1 to Scn of the cathode driver IC 30 are switched to the resistor Rc0 side, setting the cathode potential of each of the organic EL elements connected to the row electrode lines to the voltage Vc0. Through the above process, the residual charges in all the parasitic capacitors C of the display panel 10 are uniformed.

Then, when the reset period is over and the light emission period starts, the cathode driver IC 30 selects one switching element of the switching elements Sc1 to Scn, and switches the one switching element to the resistor Rsc side, and switches the other switching elements to the resistor Rre side. The one switching element is connected to the scan line of the row electrode lines, and the other switching elements are connected to the non-scan lines of the row electrode lines. Thus, the voltage Vcscn is supplied to the cathodes of the organic EL elements that are connected to the scan line (FIG. 3C), and the voltage Vrev is supplied to the cathodes of the organic EL elements that are connected to the non-scan lines (FIG. 3D).

In the light emission period, the switching elements Sa1 to Sam in the anode driver IC 20 is controlled in accordance with the anode driver control signal that is supplied from the control circuit 40. The anode driver control signal designates at least one switch element which is connected through a column electrode line to an organic EL element to be driven for light emission on the scan line. The column electrode line is called a light emission column electrode line. Here, assuming that a plurality of switch elements are designated, in the anode driver IC 20, the designated switch elements of the switching elements Sa1 to Sam are switched into the neutral selection state. The other switch elements of the switching elements Sa1 to Sam are switched to the resistor Rsa side. Thus, the anodes of the organic EL elements which respectively connected to the designated switch elements through the column electrode lines become open, and the anodes of the organic EL elements which respectively connected to the other switch elements through the column electrode lines are set to the voltage Vascn (FIG. 3B).

It should be noted that the voltage Vcscn is set to a value such that a forward voltage is applied to the organic EL elements on the light emission column electrode line which is in the open state, and the voltage Vrev is set to a value such that a reverse voltage is applied to the organic EL elements by opening the anodes of the organic EL elements.

The voltages Va0, Vc0, Vascn and Vcscn can be set to the same voltage, for example, a ground potential (0V).

Due to the initialization process in the previous reset period, the parasitic capacitors of all the organic EL elements of the display panel 10 are uniformed in charge, and the anode potential of all the organic EL elements becomes Va0 and the cathode potential becomes Vc0. For that reason, at the beginning of the light emission period, when the potential of each of the cathodes of the organic EL elements connected to the non-scan lines is changed from Vc0 to Vrev, then the potential of the anodes of these organic EL elements is changed from Va0 to Va0+(Vrev−Vc0).

In other words, this is because the potential on the anode side is changed by the potential change (Vrev−Vc0) the cathode of the organic EL elements due to the law of charge preservation in the parasitic capacitors C.

Similarly, when the cathode potential of each of the organic EL elements connected to the scan line is changed from Vc0 to Vcscn, the anode potential of each of those organic EL elements is changed from Va0 to Va0+(Vcscn−Vc0). This change is not considered in connection with the above organic EL elements connected to the non-scan lines.

As can be understood from FIG. 2, on each of the first and m-th light emission column electrode lines (connected to the designated switch elements Sa1 and Sam), the cathode of only one organic EL element is connected to the scan line, and the cathodes of all the other organic EL elements are connected to the non-scan lines. Consequently, the number of cathodes connected to the non-scan lines is greater than the number of cathodes connected to the scan line.

Also, the anodes of all the organic EL elements on each of the light emission column electrode lines are commonly connected to one another. Thus, the potential of these common anodes is substantially the potential of the anodes of the organic EL elements connected to the non-scan lines.

That is, if a condition of Vcscn<Vrev is set, then leak current is allowed to flow into each of the organic EL elements, which are at the intersecting positions by the scan line and the light emission column electrode lines, via the parasitic capacitors of the other organic EL elements which are connected to the non-scan lines. Also, if the potential difference Vrev−Vcscn between the voltage Vrev and the voltage Vcscn exceeds the light emission threshold voltage of the organic EL elements, the organic EL elements, into each of which the leak current is flowing, emit light.

On the other hand, when the relationship between the voltage Vascn in the anode driver IC 20 and the voltage Vcscn in the cathode driver IC 30 is set so that Vascn<Vcscn, then the organic EL elements at the intersecting positions by the scan line and the non-light emission column electrode lines, which are other than the light emission column electrode lines, is applied with a reverse voltage. For this reason, the organic EL elements, which are applied with the reverse voltage on the non-light emission column electrode lines, do not emit light. It should be noted that the level of the reverse voltage is of course set so that it does not affect the quality of the organic EL elements.

Also, the above relationship is the same for the other embodiment of the present invention described later and shown in FIG. 4.

That is, in the embodiment shown in FIG. 2, the leak current is allowed to flow, via the parasitic capacitors of the organic EL elements on the non-scan lines, into the organic EL elements where the second row intersects the first column and where it intersects the m-th column, and these organic EL elements (in FIG. 2, the organic EL elements of the organic EL display panel 10 that are shown in white) emit light.

As described above, in this embodiment, the leak current of the parasitic capacitors of the capacitively coupled non-light emission elements on the light emission column electrode lines is used as the drive current for the organic EL elements to be driven for light emission. Thus, A constant current driving circuit that conventionally was required for each column of the anode driver IC is not necessary, and this allows the anode driver IC to be simplified.

It should be noted that in accordance with actual design conditions, various values can be used for the voltage Va0 that is set on the anode side and the voltage Vc0 that is set on the cathode side in the initializing process. For example, if the value of Va0 is set to near the light emission threshold voltage of the organic EL elements and the value of Vc0 is set equal to or less than the ground potential, then the time until that the organic EL elements starts light-emitting can be reduced and the value of the leak current through the parasitic capacitors can be increased to improve the response and the light emission luminance of the light emitting elements.

Figure 4:
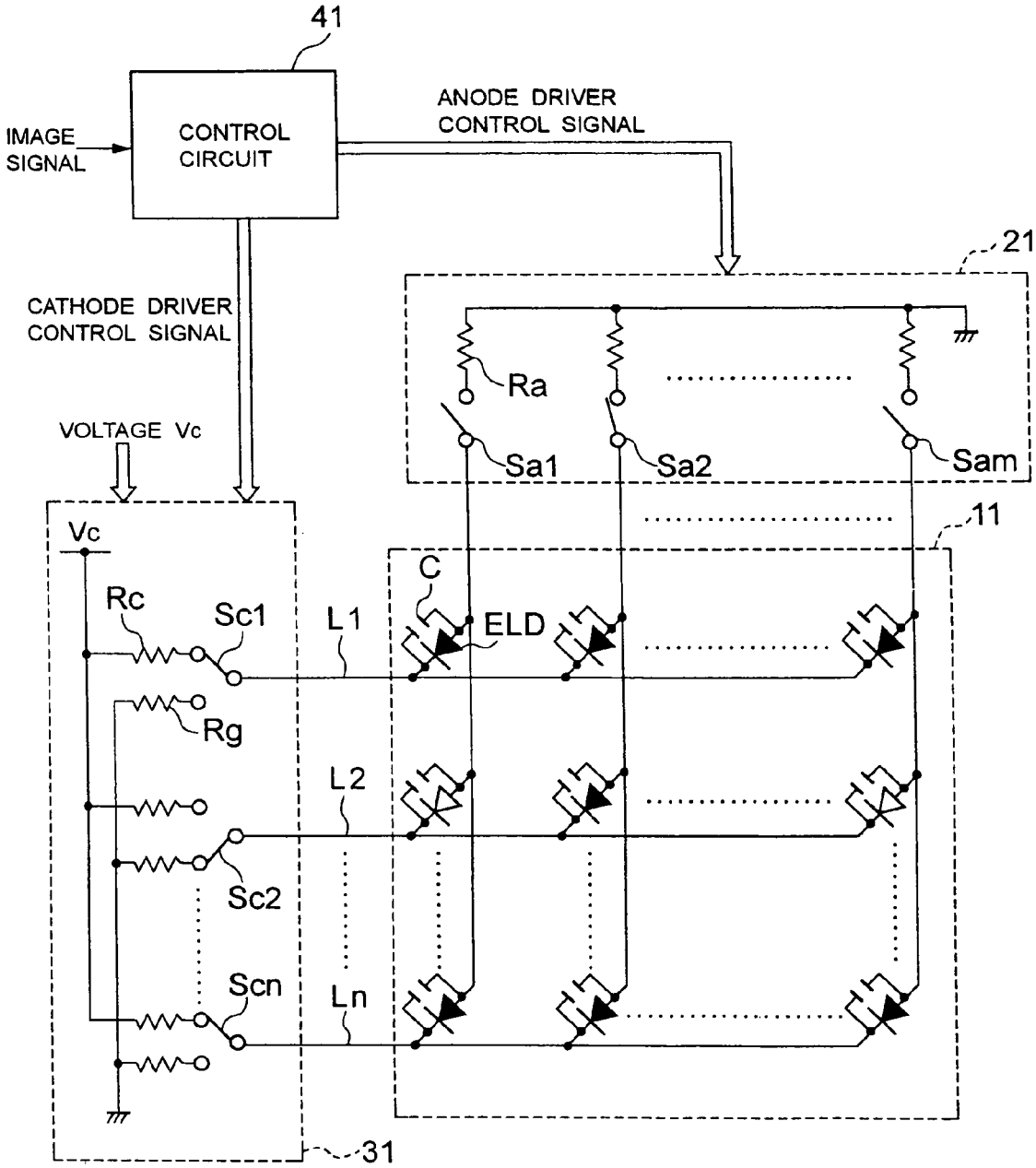
FIG. 4 is a block diagram showing another embodiment of the present invention.

FIG. 4 shows, as another embodiment of the present invention, an organic EL display panel driving device in which organic EL elements as the light emitting elements are used.

In FIG. 4, an organic EL display panel 11 has m column electrode lines and n row electrode lines L1 to Ln intersecting with the column electrode lines, and m×n organic EL elements ELD. The organic EL elements ELD are arranged at intersecting positions by the row electrode lines and the column electrode lines, respectively. Namely, the organic EL elements ELD are arranged in a matrix (n rows×m columns) in the organic EL display panel 11.

Each of the organic EL elements consists of an anode electrode, a cathode electrode, and an organic EL light emitting layer sandwiched between the anode electrode and the cathode electrode, and has rectifying properties like ordinary diodes. Also, as shown in FIG. 4, since each of the organic EL elements ELD has a parasitic capacitance C in the organic EL light emitting layer, the parasitic capacitor C is indicated as an element equivalently connected in parallel to each of the organic EL elements ELD.

The anode electrodes of the organic EL elements ELD are connected to an anode driver IC 21 through the corresponding column electrode line of the display panel 11 for each column. Also, the cathode electrodes are connected to a cathode driver IC 31 through the corresponding row electrode line of the matrix for each row.

The anode driver IC 21 includes switching elements Sa1 to Sam, and resistors Ra corresponding to the column electrode lines, respectively. Each of the switching elements Sa1 to Sam, which is an ON-OFF switch, is controlled in accordance with an anode driver control signal that is supplied from a control circuit 41. One ends of the resistors Ra are commonly connected to a ground, and the other ends are connected to one ends of the switching elements Sa1 to Sam, respectively. The other ends of the switching elements Sa1 to Sam are connected to the column electrode lines, respectively.

On the other hand, the cathode driver IC 31 includes switching elements Sc1 to Scn, resistors Rc, and Rg corresponding to the row electrode lines, respectively. Each of the switching elements Sc1 to Scn has one of two selection states, a first selection state in which the selection output is connected to one end of the resistor Rc, and a second selection state in which the selection output is connected to one end of the resistor Rg, in accordance with a cathode driver control signal that is supplied from the control circuit 41. The other ends of the resistors Rc are connected to a supply line of a voltage Vc, and the other ends of the resistors Rg are commonly connected to the ground. The voltage Vc is supplied from a cathode driver power circuit (not shown). The selection outputs of the switching elements Sc1 to Scn are connected to the row electrode lines, respectively.

The operation of the circuit shown in FIG. 4 will be described with reference to the time charts shown in FIGS. 5A to 5D.

The control circuit 41 generates the anode driver control signal and cathode driver control signal in accordance with an input image signal.

Figures 5A, 5B, 5C, 5D:
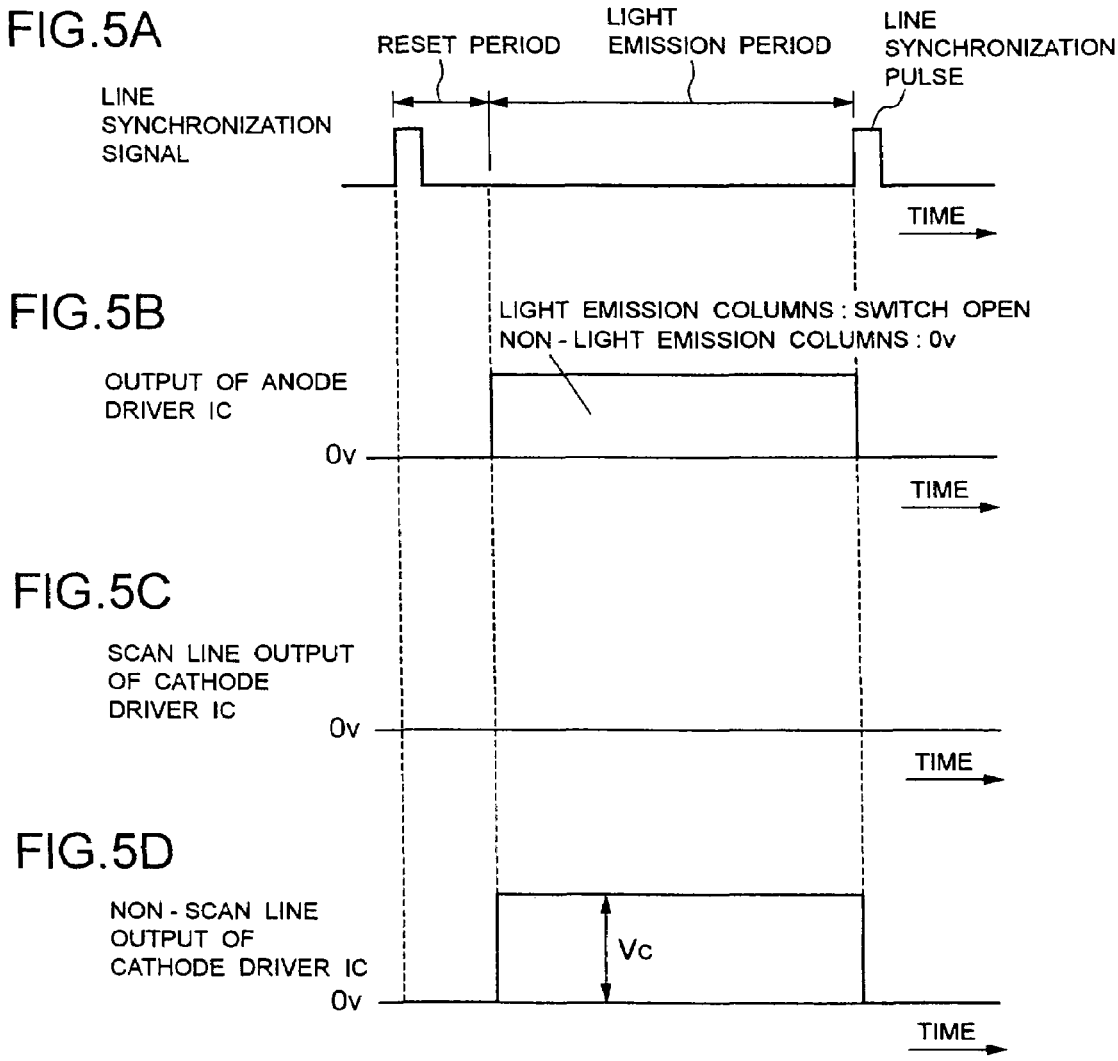
FIGS. 5A to 5D are time charts showing the operation of the device shown in FIG. 4.

FIG. 5A shows line synchronization pulses included in the cathode driver control signal that is supplied from the control circuit 41 to the driver IC 31. The cathode driver control signal is a signal which indicates one switch element of the switching elements Sc1 to Scn to select as a scan line, one row electrode line of the row electrode lines L1 to Ln in that order for each line synchronization pulse. The light emission operation for one line of the display panel 11 is carried out during one cycle of the line synchronization pulse. As shown in FIG. 5A, one cycle of the line synchronization pulse includes two periods, a reset period and a light emission period. Here, the reset period is a period during which an initializing process for the light emitting elements of the display panel 11 is carried out, and the light emission period is a period during which a process for actually light-emitting from desired light emitting elements.

FIG. 5B shows a state of the output from the anode driver IC 21 to the column electrode lines of the display panel 11.

Also, FIGS. 5C and 5D illustrate the change in the output from the cathode driver IC 31 to the row electrode lines of the display panel. FIG. 5C shows the output of a selected scan line, and FIG. 5D shows the output of the non-scan lines, that is, the lines other than the scan line.

First, in one cycle of a line synchronization pulse, when the reset period following the line synchronization pulse is begun, the initializing process for the display panel 11 is performed in the anode driver IC 21 and the cathode driver IC 31.

The initializing process will be described in detail below. All the switching elements Sa1 to Sam of the anode driver IC 21 are turned on, setting the anode potential of each of the organic EL elements ELD connected to the column electrode lines of the display panel 11 to the ground potential (0V). At the same time, all the switching elements Sc1 to Scn of the cathode driver IC 31 are switched to the resistor Rg side, setting the cathode potential of each of the organic EL elements connected to the row electrode lines to the ground potential. Through the above process, the residual charges in all the parasitic capacitors C of the display panel 11 are uniformed.

Then, when the reset period is over and then the light emission period starts, the cathode driver IC 31 selects one switching element of the switching elements Sc1 to Scn, and maintains the one switching element to the resistor Rg side, and switches the other switching elements to the resistor Rc side. The one switching element is connected to the scan line of the row electrode lines, and the other switching elements are connected to the non-scan lines of the row electrode lines. Thus, the ground potential is continuously supplied to the cathodes of the organic EL elements that are connected to the scan line (FIG. 5C), and the voltage Vc is supplied to the cathodes of the organic EL elements that are connected to the non-scan lines (FIG. 5D).

In the light emission period, the switching elements Sa1 to Sam in the anode driver IC 21 is controlled in accordance with the anode driver control signal that is supplied from the control circuit 41. The anode driver control signal designates at least one switch element which is connected through a column electrode line to an organic EL element to be driven for light emission on the scan line. The column electrode line is called a light emission column electrode line. Here, assuming that a plurality of switch elements are designated, in the anode driver IC 21, the designated switch elements of the switching elements Sa1 to Sam are turned off to be in a neutral selection state. The other switch elements of the switching elements Sa1 to Sam are continuously in the ON state. Thus, the anodes of the organic EL elements which respectively connected to the designated switch elements through the column electrode lines become open, and the anodes of the organic EL elements which respectively connected to the other switch elements through the column electrode lines are continuously at the ground potential (FIG. 5B).

Due to the initialization process in the previous reset period, the anode and cathode of each of the organic EL elements of the display panel 11 are equal to the ground potential (0V). For that reason, at the beginning of the light emission period, when the potential of each of the cathodes of the organic EL elements connected to the non-scan lines is changed from 0V to Vc, then the potential of the anodes of these organic EL elements is changed by the potential change (Vc−0V) on the cathode under the laws of charge preservation in the parasitic capacitors C.

Also, the cathode potential of the organic EL elements connected to the scan line is maintained at the ground potential. For each light emission column electrode line, the anode of the organic EL element connected to the scan line and the anodes of the organic EL elements connected to the non-scan lines are connected to one another. Thus, transportation of charge from the anodes of the elements that are not scanned to the anode of the element that are scanned occurs, ultimately establishing a common anode potential for the elements that are not scanned and the element that are scanned.

This common anode potential is a value that is obtained by dividing the voltage Vc by the series connection of the parasitic capacitance of the one organic EL element connected to the scan line and the parallel parasitic capacitances of (n−1) organic EL elements connected to the other, non-scan lines. Thus, when a potential Vacom is the common anode potential and C0 is the capacitance of the parasitic capacitor C of one organic EL element, the anode potential Vacom can be defined as follows:

$$\begin{aligned} Vacom &= \{((n-1)\times C0)/n\times C0)\}\times Vc \\ &= \{(n-1)/n\}\times Vc \\ &\approx Vc(assuming\ n>1). \end{aligned}$$

Consequently, due to the common anode potential Vacom≈Vc, leak current is allowed to flow into each of the organic EL elements in the scanned state via the parasitic capacitors of the organic EL elements connected to the non-scan lines. If the voltage Vc exceeds the light emission threshold voltage of the organic EL elements, the organic EL elements, into each of which the leak current is flowing, emit light.

On the other hand, the anodes of all the organic EL elements that are connected to the non-light emission column electrode lines are connected to the ground. Since the voltage Vc is applied to their cathodes as a reverse bias voltage, they do not emit light.

Consequently, in the embodiment shown in FIG. 4, the organic EL elements that are at the intersections of the second row and the first column and second row and the m-th column (in FIG. 4, the organic EL elements shown in white in the organic EL display panel 11) emit light due to the leak current that is allowed to flow through the parasitic capacitors of the organic EL elements that are connected to the non-scan lines of the column electrode lines.

As described above, in this embodiment, the leak current of the parasitic capacitors of the capacitively coupled non-light emission elements on the light emission column electrode lines is used as the drive current for the light emitting elements. Thus, the constant current driving circuits conventionally required for each column electrode line of the anode driver IC become unnecessary, allowing the anode driver IC to be simplified.

Also, in this embodiment, the potential that is set in the initializing process in the reset period, the drive potential that is supplied to the scan line, and the control potential that is supplied to the non-light emission column electrode lines are set to the ground potential. Thus, there is a reduction in the types of power voltage required by the anode driver IC 21 and the cathode driver IC 31, allowing the power circuit to be made simple and compact.

The present invention is not limited to the embodiments described above.

For example, the line synchronization pulse shown in FIGS. 3A and 5A can also be a pattern in which the scanning of the reset period and the light emission period in one cycle is repeated a plurality of times. By adopting such a configuration, a display gradation corresponding to the gradation command of the image data can be achieved by increasing the number of repeats when the gradation setting of the image data supplied from the control circuit is high, and decreasing the number of repeats when the gradation setting is low.

It should be noted that if the above-described configuration in which a plurality of reset period and light emission period scans are performed within the scan period for one line is adopted, then by independently controlling the scan time for each of these plurality of scans, it is possible to perform so-called gamma correction for the image data.

It is also possible for the resistor elements in the anode driver IC that are connected to the light emission column electrode lines to be configured by, for example, a so-called active attenuator that allows the resistance to be adjusted through an analog switch, so that during the light emission period the values of the resistor elements can be adjusted in accordance with the gradation of the image signal. With this configuration as well, it is possible to achieve a display gradation that corresponds to the gradation of the image signal.

Also, in the examples shown in the embodiments described above, organic EL elements are used as the light emitting elements. However, the present invention is not limited to this configuration.

This application is based on a Japanese Patent Application No. 2002-305950 which is hereby incorporated by reference.

What is claimed is:

1. A display panel driving device comprising:

a display panel having a plurality of row electrode lines, a plurality of column electrode lines intersecting with said row electrode lines, and a plurality of capacitive light emitting elements arranged at a plurality of intersecting positions by said plurality of row electrode lines and said plurality of column electrode lines, respectively;

a control circuit which generates a column drive control signal and a row drive control signal for each one cycle having a reset period and a light emission period in accordance with an input image signal, the row drive control signal indicating, as a scan line, one line of said plurality of row electrode lines and the column drive control signal indicating, as a light emission column electrode line corresponding to a capacitive light emitting element driven to emit light on said scan line, at least one line of a plurality of column electrode lines;

a column electrode driver circuit which sets a potential of each of said plurality of column electrode lines in accordance with the column drive control signal; and a row electrode driver circuit which sets a potential of each of said plurality of row electrode lines in accordance with the row drive control signal;

wherein said column electrode driver circuit, in said reset period supplies a first reset potential to each of said plurality of column electrode lines, and in said light emission period, opens the light emission column electrode line and supplies a non-light emission control potential to column electrode lines other than the light emission column electrode line of said plurality of column electrode lines; and wherein said row electrode driver circuit, in said reset period, supplies a second reset potential to each of said plurality of row electrode lines, and in said light emission period, supplies a selection potential to the scan line and supplies a non-selection potential to row electrode lines other than the scan line of said plurality of row electrode lines, so that a leak current flows into the capacitive light emitting element driven to emit light, as a drive current, via parasitic capacitors of the capacitive light emitting elements connected between said row electrode lines other than the scan line and the light emission column electrode line in said light emission period.

2. The display panel driving device according to claim 1, wherein said first and second reset potentials, said non-light emission control potential, said selection potential are equal to a ground potential, and said non-selection potential is greater than the ground potential.

3. The display panel driving device according to claim 1, wherein a number of repeats of said reset period and said light emission period in each of said cycles is adjusted in accordance with a gradation of said image signal.

4. The display panel driving device according to claim 1, wherein said column electrode driver circuit supplies the first reset potential or the non-light emission control potential to said plurality of column electrode lines through resistor elements each of which is adjusted in accordance with a gradation of said image signal.

5. The display panel driving device according to claim 1, wherein said light emitting elements are organic electroluminescence elements.

6. A method for driving a display panel having a plurality of row electrode lines, a plurality of colunm electrode lines intersecting with said row electrode lines, and a plurality of capacitive light emitting elements arranged at a plurality of intersecting positions by said plurality of row electrode lines and said plurality of colunm electrode lines, respectively; comprising steps of:

generating a column drive control signal and a row drive control signal for each one cycle having a reset period and a light emission period in accordance with an input image signal, the row drive control signal indicating, as a scan line, one line of said plurality of row electrode lines and the column drive control signal indicating, as a light emission column electrode line corresponding to a capacitive light emitting element driven to emit light on said scan line, at least one line of a plurality of column electrode lines;

setting a potential of each of said plurality of column electrode lines in accordance with the column drive control signal; and setting a potential of each of said plurality of row electrode lines in accordance with the row drive control signal;

wherein in said reset period, a first reset potential is supplied to each of said plurality of column electrode lines and a second reset potential is supplied to each of said plurality of row electrode lines, and in said light emission period, the light emission column electrode line is opened and a non-light emission control potential is supplied to column electrode lines other than the light emission column electrode line of said plurality of column electrode lines, a selection potential is supplied to the scan line and a non-selection potential is supplied to row electrode lines other than the scan line of said plurality of row electrode lines, so that a leak current flows into the capacitive light emitting element driven to emit light, as a drive current, via parasitic capacitors of the capacitive light emitting elements connected between said row electrode lines other than the scan line and the light emission column electrode line in said light emission period.

* * * * *